US006446434B1

(12) United States Patent
Lin et al.

(10) Patent No.: US 6,446,434 B1
(45) Date of Patent: Sep. 10, 2002

(54) POWER MACHINERY FOR TEMPERATURE-DIFFERENTIAL ENGINE

(75) Inventors: Pao Lung Lin, No. 69, Lane 99, Chin Shan Rd. Shih Lin Dist., Taipei (TW); Chun-Hsiung Han, Taipei Hsien (TW)

(73) Assignees: Polo Technology Corp., Taipei Hsien (TW); Pao Lung Lin, Taipei (TW)

( * ) Notice: Subject to any disclaimer, the term of this patent is extended or adjusted under 35 U.S.C. 154(b) by 0 days.

(21) Appl. No.: 09/987,508

(22) Filed: Nov. 15, 2001

(51) Int. Cl.[7] ..... F01B 1/00
(52) U.S. Cl. ..... 60/508; 92/31
(58) Field of Search ..... 60/508; 92/31, 92/165 PR

(56) References Cited

U.S. PATENT DOCUMENTS 3,508,472 A * 4/1970 Hartwick, Jr. ..... 92/31 X
3,530,769 A * 9/1970 Gurevich ..... 92/31
3,901,034 A * 8/1975 Minzinger ..... 60/519
5,241,895 A * 9/1993 Weyer ..... 92/31 X

* cited by examiner

*Primary Examiner*—Hoang Nguyen
(74) *Attorney, Agent, or Firm*—Rosenberg, Klein & Lee

(57) ABSTRACT

A power machinery for a temperature-differential engine comprises a first valving piston, a power piston, a second valving piston, a spindle, a countershaft and a flywheel. The power piston and the second valving piston have spiral grooves on outer surface thereof and the flywheel is fit on the grooves through a sliding member. The flywheel moves along the grooves on the power piston and the second valving piston and has a rotation motion when the first valving piston, the power piston and the second valving piston have reciprocating motion along the spindle. The countershaft is used to keep a fixed separation between the first valving piston and the second valving piston.

9 Claims, 7 Drawing Sheets

POWER MACHINERY FOR TEMPERATURE-DIFFERENTIAL ENGINE

FIELD OF THE INVENTION

The present invention relates to a power machinery for a temperature-differential engine, especially to a power machinery for a temperature-differential engine operated in principle of temperature difference and having groove on outer surface of the piston to drive the flywheel in rotatory motion.

BACKGROUND OF THE INVENTION

There are many kinds of commercially available engines now. For example, a reciprocating piston engine utilizes crankshaft to convert reciprocating linear motion to rotational motion of flywheel. The reciprocating piston engine has advantages of robust and smooth operation.

In above-mentioned reciprocating piston engine, the crankshaft has vibration problem due to bias loading thereof. Therefore, the crankshaft should be used with balance weight to reduce vibration. However, the reciprocating piston engine becomes bulky and complicated.

SUMMARY OF THE INVENTION

It is an object of the present invention to provide a power machinery for a temperature-differential engine operated in principle of temperature difference and not using crankshaft.

It is another object of the present invention to provide a power machinery for a temperature-differential engine, which drives the piston in reciprocating way in a cylinder by the principle of temperature difference.

To achieve above object, the present invention provides a power machinery for a temperature-differential engine comprising a first valving piston, a power piston, a second valving piston, a. spindle, a countershaft and a flywheel. The spindle passes through in turn the first valving piston, the power piston and the second valving piston The power piston and the second valving piston have spiral grooves on outer surface thereof and the flywheel is fit on the grooves through a sliding member. The flywheel moves along the grooves on the power piston and the second valving piston and has a rotation motion when the first valving piston, the power piston and the second valving piston have reciprocating motion along the spindle. The countershaft is used to keep a fixed separation between the first valving piston and the second valving piston.

The various objects and advantages of the present invention will be more readily understood from the following detailed description when read in conjunction with the appended drawing, in which:

DETAILED DESCRIPTION OF THE INVENTION

Figure 1:
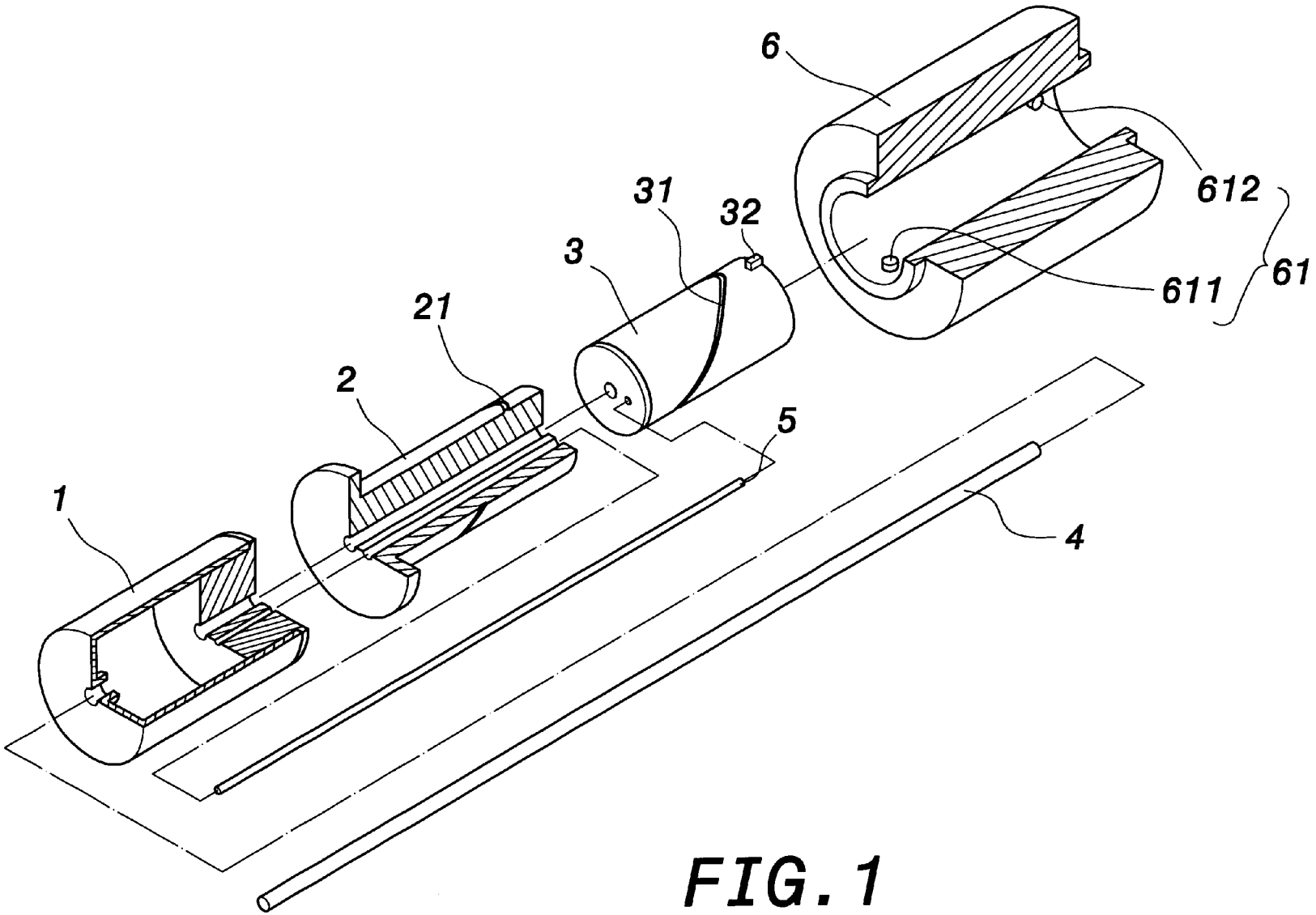
FIG. 1 shows an exploded view of the present invention.

FIG. 1 shows the exploded view of the present invention. The present invention provides a power machinery for a temperature-differential engine and the power machinery comprises a first valving piston 1, a power piston 2, a second valving piston 3, a spindle 4, a countershaft 5 and a flywheel 6.

The power piston 2 and the second valving piston 3 have spiral grooves 21 and 31, respectively, on outer surface thereof. The spindle 4 in turn passes through the first valving piston 1, the power piston 2, and the second valving piston 3 such that the first valving piston 1, the power piston 2 , and the second valving piston 3 have reciprocating movement along the spindle 4. The countershaft 5 is connected to the first valving piston 1 and the second valving piston 3 through the power piston 2 such that the first valving piston 1 and the second valving piston 3 have a fixed separation therebetween. The flywheel 6 is slidably fit on the spiral grooves 21 and 31 through a sliding member 61. The sliding member 61 is arranged on the inner wall of the flywheel 6 and is composed of a first bump 611 and a second bump 612. More particularly, the first bump 611 is slidably fit in the spiral groove 21 of the power piston 2, and the second bump 612 is slidably fit in the spiral groove 21 of the second valving piston 3. The second valving piston 3 is provided with a guiding block 32 to prevent the rotation of the second valving piston 3 on the spindle 4.

When the first valving piston 1, the power piston 2, and the second valving piston 3 have reciprocating movement along the spindle 4, the first bump 611 and the second bump 612 of the flywheel 6 are moved along the spiral grooves 21 and 31. Therefore, the flywheel 6 has rotatory motion.

Figure 2:
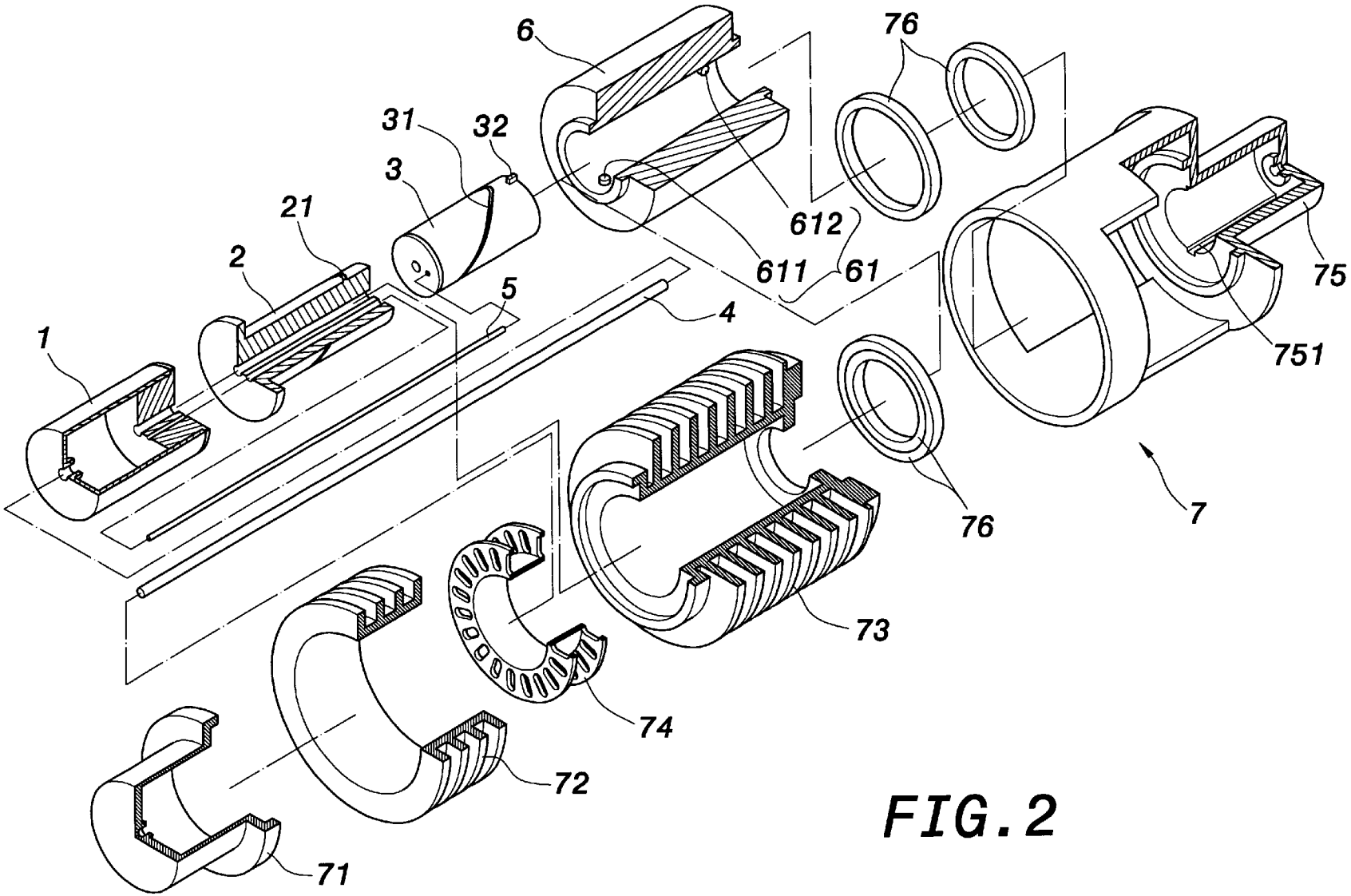
FIG. 2 shows an exploded view of the present invention assembled with a cylinder.
Figure 3:
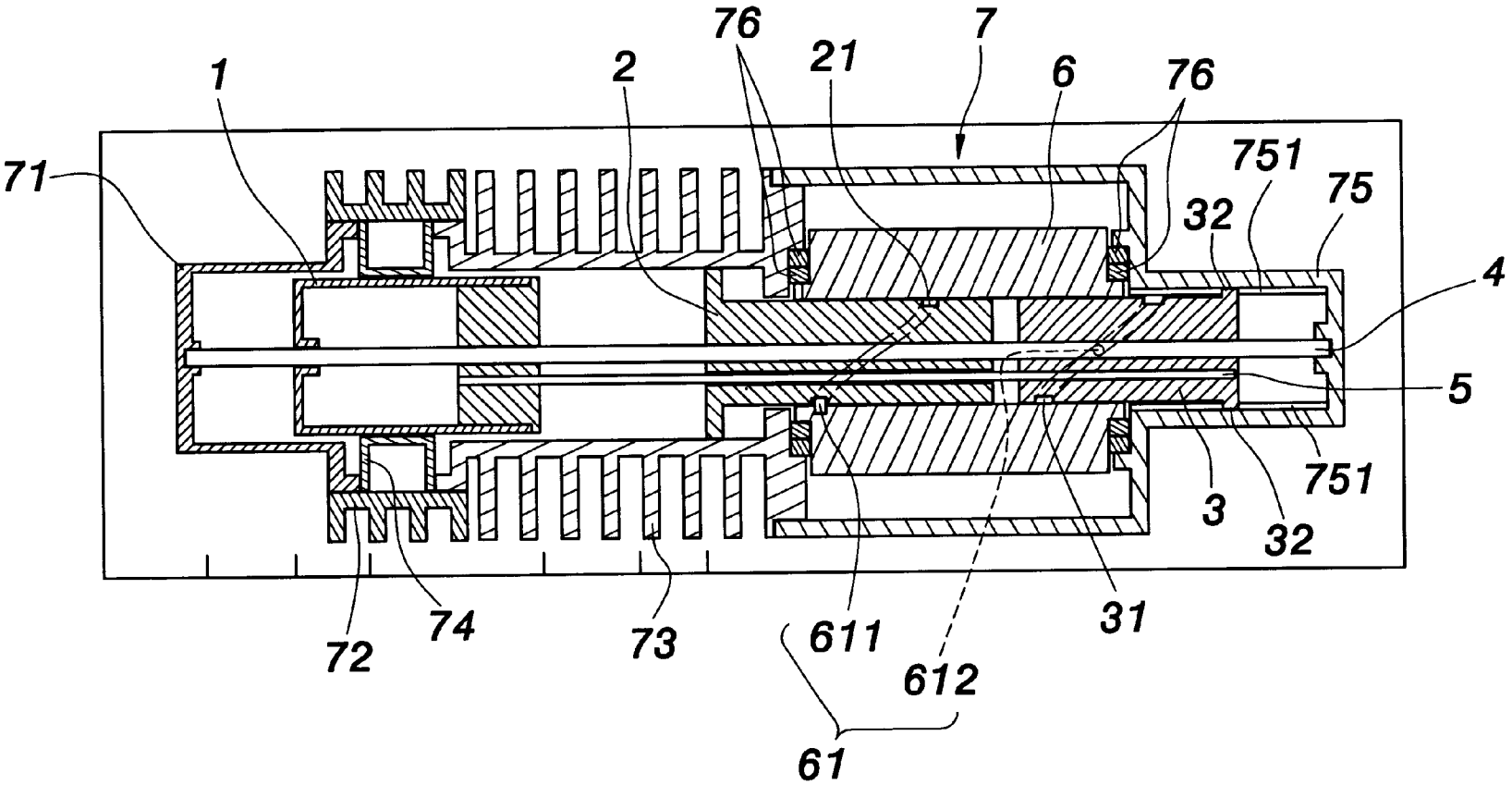
FIG. 3 shows a sectional view of the present invention assembled with a cylinder.

FIGS. 2 and 3 are an exploded view and a sectional view showing that the power machinery of the present invention is assembled with a cylinder 7. The cylinder 7 comprises a front barrel 71, two heat radiators 72 and 73, a reheater 74, a rear barrel 75 and a plurality of rings 76. The front barrel 71 is used to receive heat from an external thermal source (not shown) and the heat radiators 72 and 73 are used to remove heat of air in the cylinder 7. The reheater 74 is used to accumulate thermal energy to enhance efficiency of the cylinder 7 and the rear barrel 75 is used to receive the flywheel 6. The rings 76 are arranged within the rear barrel 75 to reduce the friction of the flywheel 6 during rotation. The spindle 4 passes through the first valving piston 1, the power piston 2, and the second valving piston 3; and the frond end and the rear end thereof further extrude into inner wall of the front barrel 71 and the rear barrel 75, respectively. The rear barrel 75 has a guiding slot 751 in which the guiding block 32 of the second valving piston 3 slides.

For normal operation of the cylinder 7, an external thermal source (not shown) is provided outside the front barrel 71 and the operation inside the cylinder 7 is described below.

Figure 4:
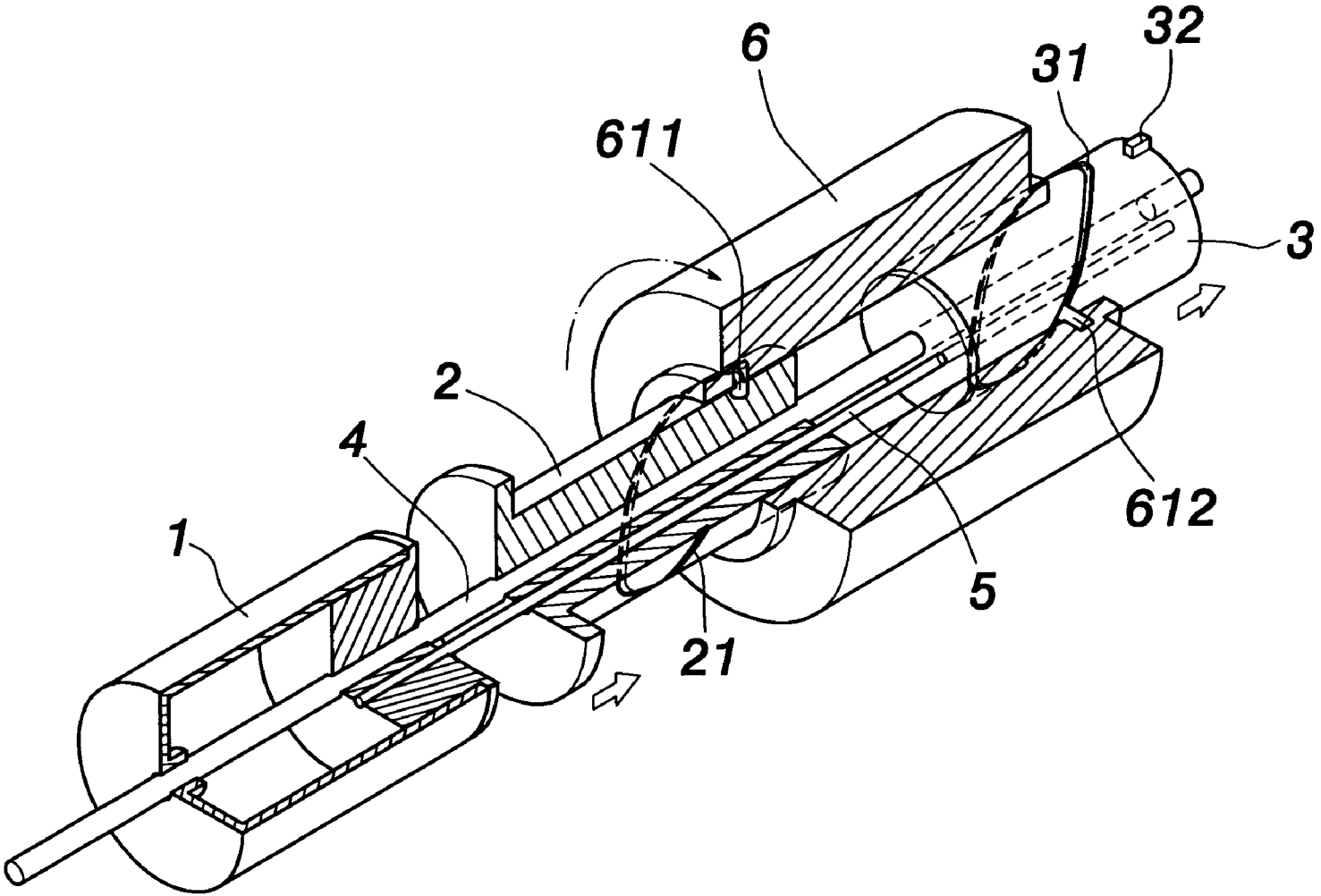
FIG. 4 shows the power machinery of the present invention in a first operation state.

FIG. 4 shows the power machinery of the present invention in a first operation state. When the front barrel 71 is heated at front side thereof, the air at front side of the front barrel 71 is also heated to expand. The first valving piston 1 is pushed to move backward along the spindle 4. The second valving piston 3 is also moved backward along the spindle 4 due to the linkage of the countershaft 5 between the first valving piston 1 and the second valving piston 3. The spiral groove 31 on the second valving piston 3 drives the second bump 612 of the flywheel 6 to rotate the flywheel 6 in clockwise direction to a position of quarter turn.

Figure 5:
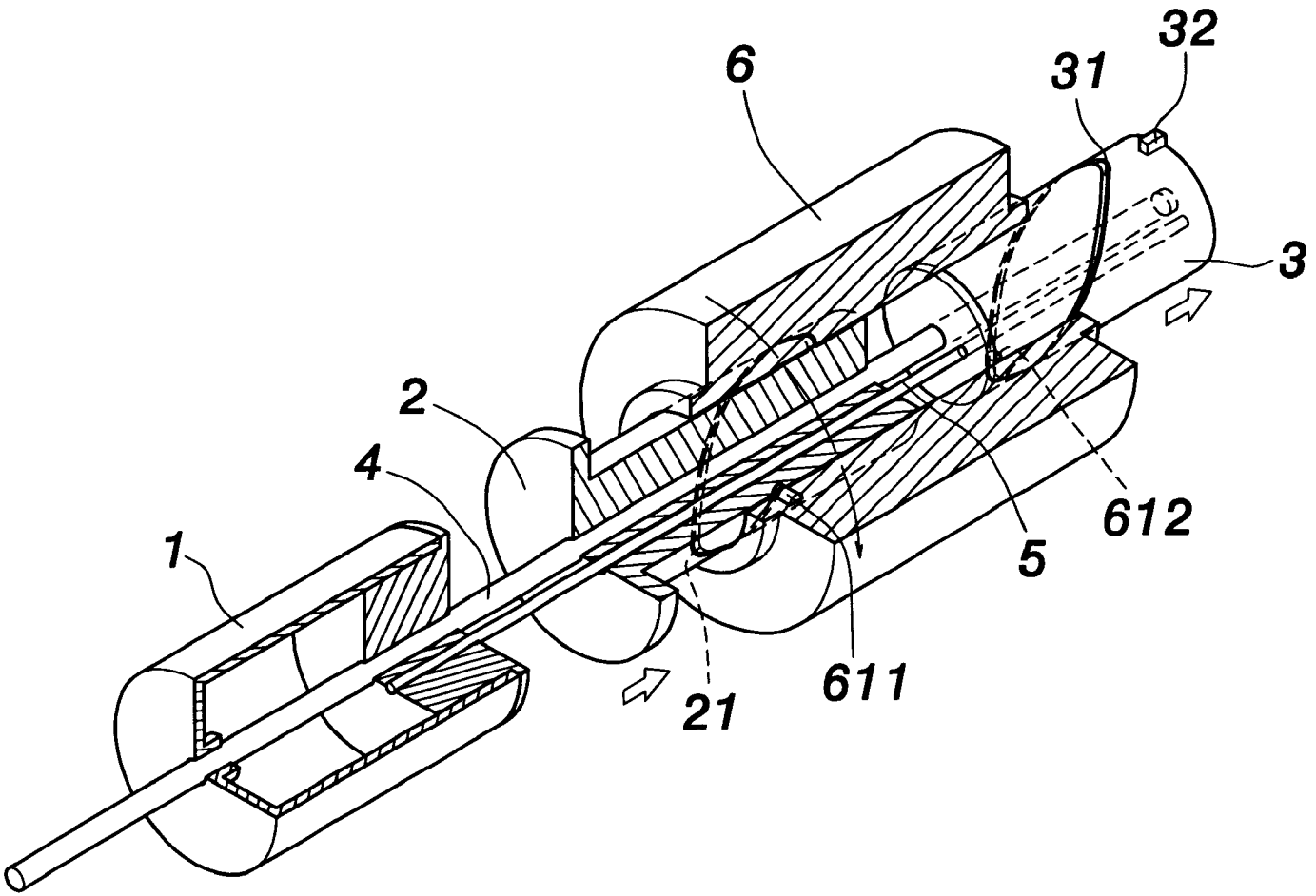
FIG. 5 shows the power machinery of the present invention in a second operation state.

FIG. 5 shows the power machinery of the present invention in a second operation state. When heated air in the front barrel 71 begins to flow to a region between the first valving piston 1 and the power piston 2 through the reheater 74, the heated air in this region pushes backward the power piston 2. The spiral groove 21 on the power piston 2 drives the first bump 611 of the flywheel 6 to rotate the flywheel 6 in clockwise direction to a position of two-quarter turn.

Figure 6:
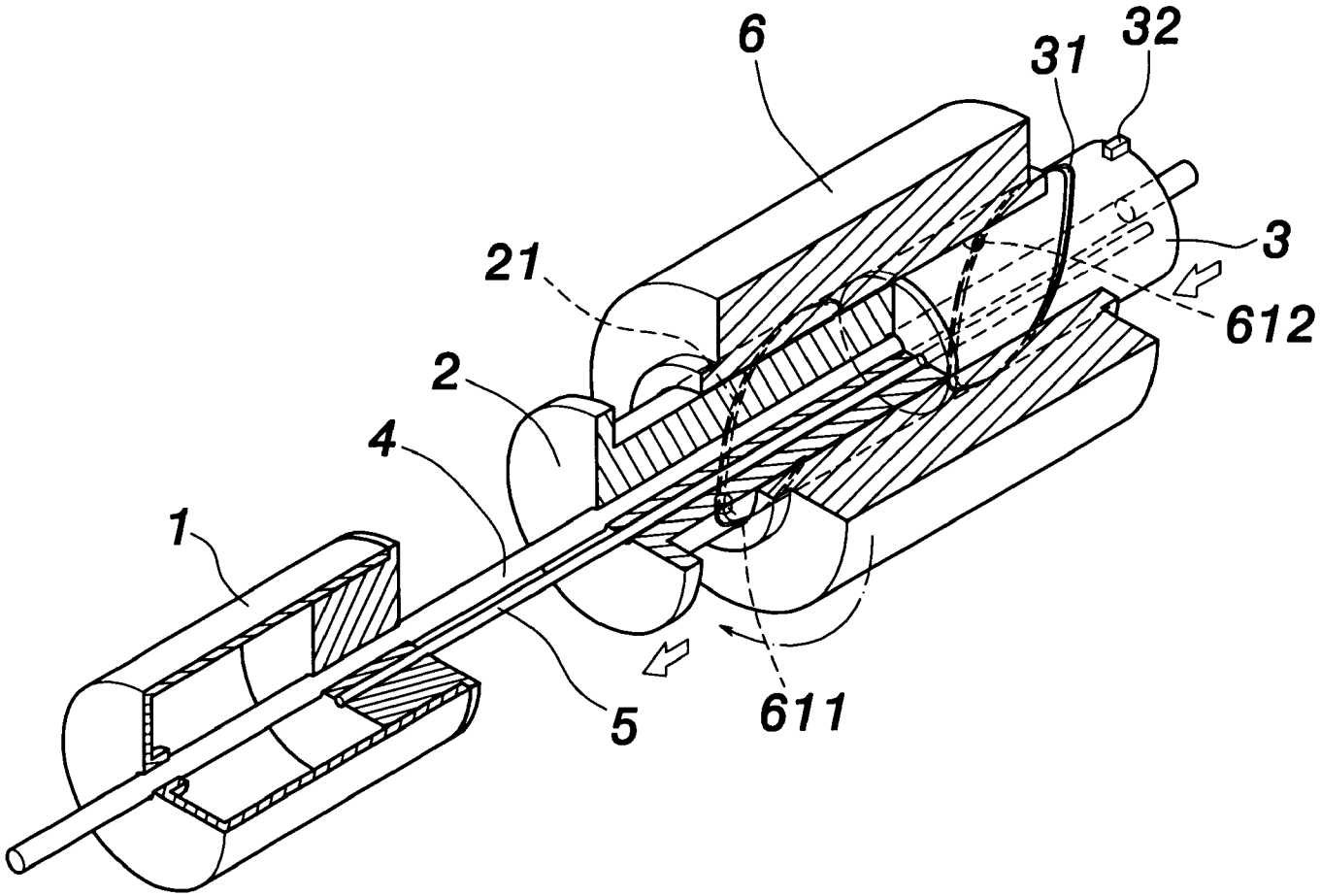
FIG. 6 shows the power machinery of the present invention in a third operation state.

FIG. 6 shows the power machinery of the present invention in a third operation state. When most of the heated air in the front barrel 71 flows to the region between the first valving piston 1 and the power piston 2 through the reheater 74, the heated air begins to pushes forward the first valving piston 1 and the second valving piston 3 is also moved forward at this time. Moreover, the heated air between the first valving piston 1 and the power piston 2 is cooled by the heat radiators 72 and 73 such that the volume of the heated air between the first valving piston 1 and the power piston 2 is reduced. As a result, the backward pushing force on the power piston 2 is also decreased and the first valving piston 1 and the power piston 2 keep moving forward. The spiral groove 21 on the power piston 2 and the spiral groove 31 on the second valving piston 3 drive the first bump 611 and the second bump 612 of the flywheel 6 to rotate the flywheel 6 in clockwise direction to a position of third-quarter turn.

Figure 7:
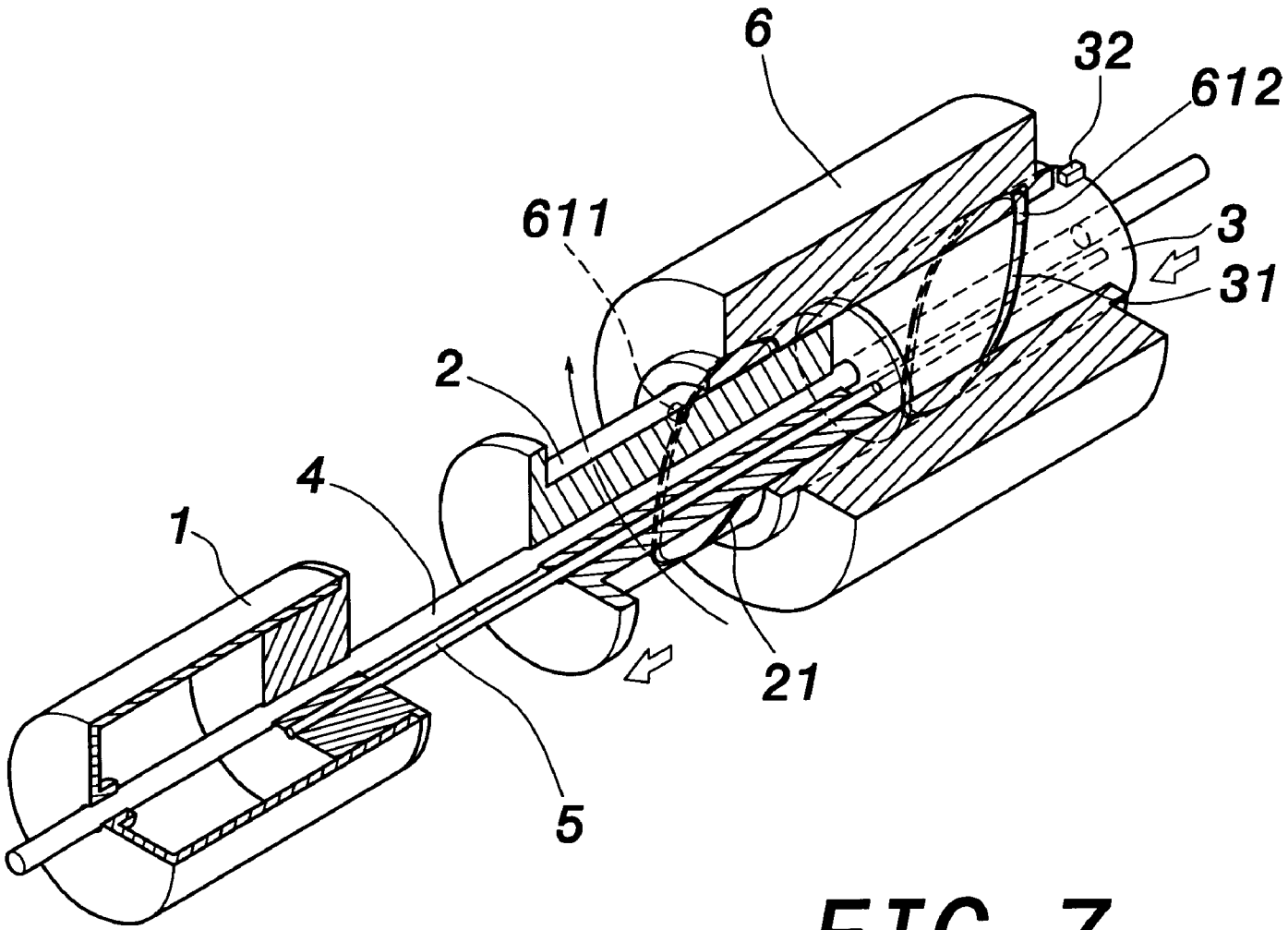
FIG. 7 shows the power machinery of the present invention in a fourth operation state.

FIG. 7 shows the power machinery of the present invention in a fourth operation state. The air between the first valving piston 1 and the power piston 2 is further cooled by the heat radiators 72 and 73 such that the volume of the heated air between the first valving piston 1 and the power piston 2 is greatly reduced. As a result, the backward pushing force on the power piston 2 is also decreased and the power piston 2 keeps moving forward. The spiral groove 21 on the power piston 2 drives the first bump 611 of the flywheel 6 to rotate the flywheel 6 in clockwise direction to origin position. Afterward, the air in the front barrel 71 is again heated to bring the power machinery of the present invention to the first operation state as shown in FIG. 4

In the present invention, a stable external thermal source is provided outside the front barrel 71 such that the pistons in the cylinder 7 have reciprocating motion. The spiral groove 21 on the power piston 2 and the spiral groove 31 on the second valving piston 3 drive the first bump 611 and the second bump 612 of the flywheel 6 to rotate the flywheel 6. Moreover, the flywheel 6 can be made of magnetic material and coils are provided around the flywheel 6 such that the cylinder 7 is used as an induction generator. Moreover, the first bump 611 and the second bump 612 of the flywheel 6 are staggered by 90° with respect to the spindle 4, thus ensuring the flywheel 6 to fly in uni-direction.

To sum up, the power machinery for a temperature-differential engine according to the present invention has following features:

(1) The piston is operated in principle of temperature difference.

(2) The piston has spiral grooves on outer surface thereof to convert reciprocating linear motion of the piston to rotational motion of the flywheel.

(3) The present invention uses a stable thermal source as power source.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A power machinery for a temperature-differential engine, comprising a first valving piston;

a power piston having a groove on an outer surface thereof;

a second valving piston having a groove on an outer surface thereof;

a spindle passing through in turn the first valving piston, the power piston and the second valving piston; and the first valving piston, the power piston and the second valving piston having reciprocating motion along the spindle;

a countershaft used to keep a fixed separation between the first valving piston and the second valving piston; and a flywheel being fit on the groove through a sliding member;

wherein the flywheel moves along the grooves on the power piston and the second valving piston and has a rotation motion when the first valving piston, the power piston and the second valving piston have reciprocating motion along the spindle.

2. The power machinery for a temperature-differential engine as in claim 1, wherein the groove on the power piston has spiral trajectory.

3. The power machinery for a temperature-differential engine as in claim 1, wherein the groove on the second valving piston has spiral trajectory.

4. The power machinery for a temperature-differential engine as in claim 1, wherein the sliding member is arranged on an inner wall of the flywheel and composed of a first bump and a second bump.

5. The power machinery for a temperature-differential engine as in claim 4, wherein the first bump is fit in the groove on the power piston.

6. The power machinery for a temperature-differential engine as in claim 4, wherein the second bump is fit in the groove on the second valving piston.

7. The power machinery for a temperature-differential engine as in claim 4, wherein the first bump and the second bump are staggered by a predetermined phase difference with respect to the spindle.

8. The power machinery for a temperature-differential engine as in claim 4, wherein the phase difference is 90°.

9. The power machinery for a temperature-differential engine as in claim 1, wherein the flywheel is made of magnetic material and provided with coil to function as induction generator.

* * * * *